United States Patent [19]

Parry

[11] Patent Number: 4,662,146

[45] Date of Patent: May 5, 1987

[54] BUILDING FRAME SUPPORT AND METHOD OF ERECTION

[76] Inventor: Rodger J. Parry, 506 Limber Road, Meadville, Pa. 16335

[21] Appl. No.: 741,929

[22] Filed: Jun. 6, 1985

Related U.S. Application Data

[63] Continuation of Ser. No. 497,008, May 23, 1983, abandoned.

[51] Int. Cl.[4] ..... E04G 21/00; E02D 27/42

[52] U.S. Cl. ..... 52/745; 52/120; 52/298

[58] Field of Search ..... 52/745, 641, 298, 120; 16/267, 262, 380, 386, 374

[56] References Cited

U.S. PATENT DOCUMENTS

| | | | |
|---|---|---|---|
| 460,837 | 10/1891 | Addis | 52/120 |
| 1,170,188 | 2/1916 | Rasmussen et al. | 52/641 |
| 2,403,080 | 7/1946 | Hilborn | 52/120 |
| 2,403,081 | 7/1946 | Hilborn | 52/120 |
| 2,482,918 | 9/1949 | Kump, Jr. | 52/745 |
| 2,794,208 | 6/1957 | Scroggins | 16/267 |
| 2,985,261 | 5/1961 | Kubesh | 52/120 |
| 3,008,549 | 11/1961 | Thorson | 52/120 |
| 3,015,374 | 1/1962 | Carbert et al. | 52/120 |
| 3,130,651 | 4/1964 | Werner | 16/267 |
| 3,236,020 | 2/1966 | Toffolon | 52/745 |
| 3,311,333 | 3/1967 | Galloway | 52/298 |
| 3,462,908 | 8/1969 | Wysocki | 52/745 |
| 3,803,780 | 4/1974 | Donnally | 52/120 |
| 3,971,185 | 7/1976 | Hendrich | 52/745 |
| 4,144,685 | 3/1979 | Fox | 52/745 |
| 4,221,088 | 9/1980 | Patterson | 52/120 |
| 4,242,850 | 1/1981 | Merenyi et al. | 52/745 |
| 4,447,997 | 5/1984 | Delgado | 52/120 |

FOREIGN PATENT DOCUMENTS

| | | | |
|---|---|---|---|
| 7501762 | 6/1975 | Fed. Rep. of Germany | 16/267 |
| 480750 | of 0000 | France | 16/267 |
| 325365 | 2/1930 | United Kingdom | 16/262 |

*Primary Examiner*—Carl D. Friedman
*Assistant Examiner*—Michael Safavi
*Attorney, Agent, or Firm*—Charles L. Lovercheck; Wayne L. Lovercheck; Dale R. Lovercheck

[57] ABSTRACT

A method and apparatus for erecting buildings is disclosed. The method involves providing frame elements of a building which may be made up of spaced columns connected together by a beam or beams which may meet at a gable. To erect the frames, each frame is disposed horizontally on the ground with bases of the columns attached by a hinge member to a footing. A spacer bar is supported with one end in a recess in the ground or attached to the frame. A tension member such as a cable is attached to the frame at the gable and is passed over the top end of the spacer post and a vehicle or other prime mover is attached to the tension member to pull the frame to erect position. Each of the hinge members may be made of a socket to attach to the base of a column and a shoe attached to a ground support footing. Each socket is hinged to the shoe by a fowardly facing slot that receives a pin on the socket. The slot is so shaped that the pin can enter it when the column is in horizontal position, but the pin cannot slip out of the slot when the column is raised away from the horizontal position. A second pin is provided which extends through flanges on the shoe and through flanges on the socket when the column is in erect position.

3 Claims, 9 Drawing Figures

BUILDING FRAME SUPPORT AND METHOD OF ERECTION

This is a continuation of application Ser. No. 497,008, filed May 23, 1983, now abandoned 9-8-86.

REFERENCE TO THE PRIOR ART

Various gin poles and cranes and other apparatus have been provided for erecting building frames, but applicant knows of no method that has been used where a prime mover is connected to a building structure with the structure hinged to the ground and the structure then pulled into erect position. Applicant is aware of the following patents on hinge structures for connecting columns to bases however applicant believes these hinge members are not suggestive of applicant's structure or method.

U.S. Pat. No. 805,201 shows a fence post pivoted to a ground member. U.S. Pat. No. 3,351,113 shows an apparatus for supporting offshore floating loads. U.S. Pat. No. 2,605,865 shows an island strip support wherein the column structure is supported on ground anchors.

Applicant is aware of U.S. Pat. No. 4,144,645 and British Pat. No. 325,365 dated February 1930. U.S. Pat. No. 4,144,645 discloses a building erection method that requires a cenral post and two tension members working together. The British patent shows a gate stop and not applicant's claimed structure.

OBJECTS OF THE INVENTION

It is an object of the invention to provide an improved method of erecting a building structure.

Another object of the invention is to provide an improved hinge member for connecting a column to a footing member.

Another object of the invention is to provide a method of erecting buildings that is simple, economical to carry out, and simple and efficient to use.

With the above and other objects in view, the present invention consists of the combination and arrangement of parts hereinafter more fully described, illustrated in the accompanying drawing and more particularly pointed out in the appended claims, it being understood that changes may be made in the form, size, proportions, and minor details of construction without departing from the spirit or sacrificing any of the advantages of the invention.

GENERAL DESCRIPTION OF THE DRAWINGS

DETAILED DESCRIPTION OF DRAWINGS

Figure 1:
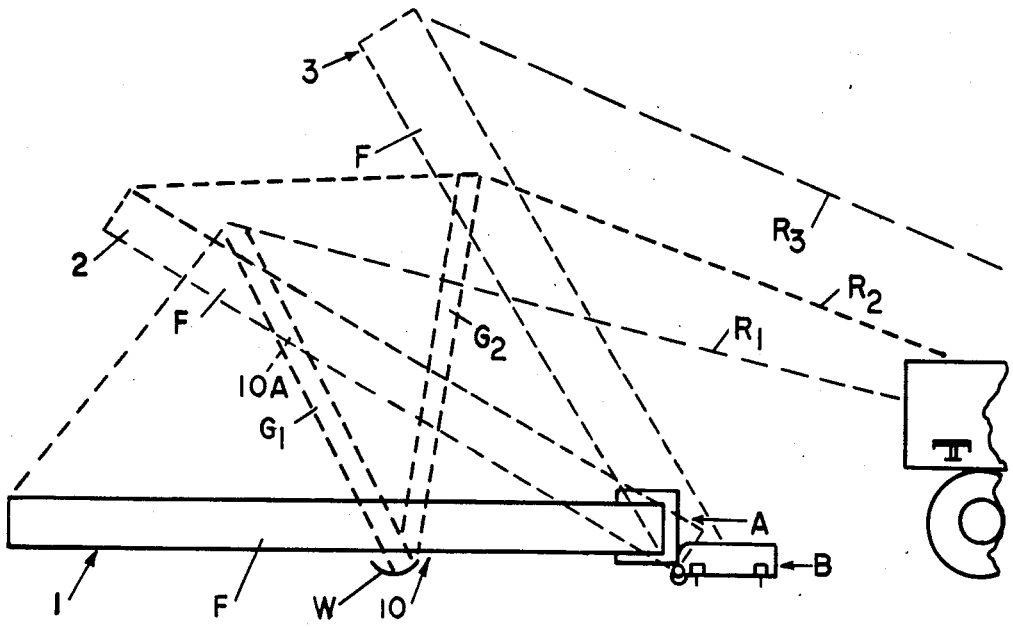
FIG. 1 is a side view of a prime mover connected to a building frame member which is connected to a footing by an improved hinge member ready to pull the building structure to erect position.

Now, with more particular reference to the drawings, I show a plurality of footings E which are set into the ground in accordance with good building practices. The footings may be spaced in accordance with the requirements specified by an architect or builder. The footings E may be in the form of concrete posts set in the ground, for example three feet below the ground surface.

The frames F are made up of columns C with rafters or beams R suppoted on their upper end and connected together at a gable G. The columns may be made of wooden column members and the rafters may be made of steel or any other materials suitable for the particular purpose.

The shoe B has a flat bottom 12, spaced sides 13 each having a flange 14 extending upwardly therefrom at the rear end thereof.

Forwardly opening slots S are formed in each of the sides 13 adjacent the front end and adjacent the bottom. The slots are cylindrical in shape and have flat bottoms 30' that are flush with the top of the flat bottom 12.

The sockets A have a flat bottom 16 and sides 19. The pintels P extend out laterally from each side and when a column C is received in the socket A with the lower end of the column C resting on the top of the bottom 16 of the socket and the column laying horizontally on the ground, the flat surface 20 of the pin P will be co-planar with the flat bottom 30' of the slots S so that the pins can be slid into the slots. Then when the column is swung upward to erect position the flat surface 20 of the pintels will be perpendicular to the bottom flat surfaces of the slots S so that the column cannot be removed.

The spacer post G1 in FIG. 1 may have its lower end set in a recess W in the ground and the tension member R' which may be a rope or cable may pass over the top of the spacer post G1 and attach to the truck T. As the truck moves forward, the tension member R will exert a force on the upper end of the frame F which will swing the spacer post G1 through the position G2 and at the same time lift the frame. As the frame F moves from position 1 to position 3, the post G1 will fall away and the tension on the tensil member R3 will be directly from the truck to the frame F. The truck will then pull the frame into erect position and at that point a pin will be inserted into the holes H1 and H2 which will be aligned at that time, thereby holding the frame in erect position.

Figure 2:
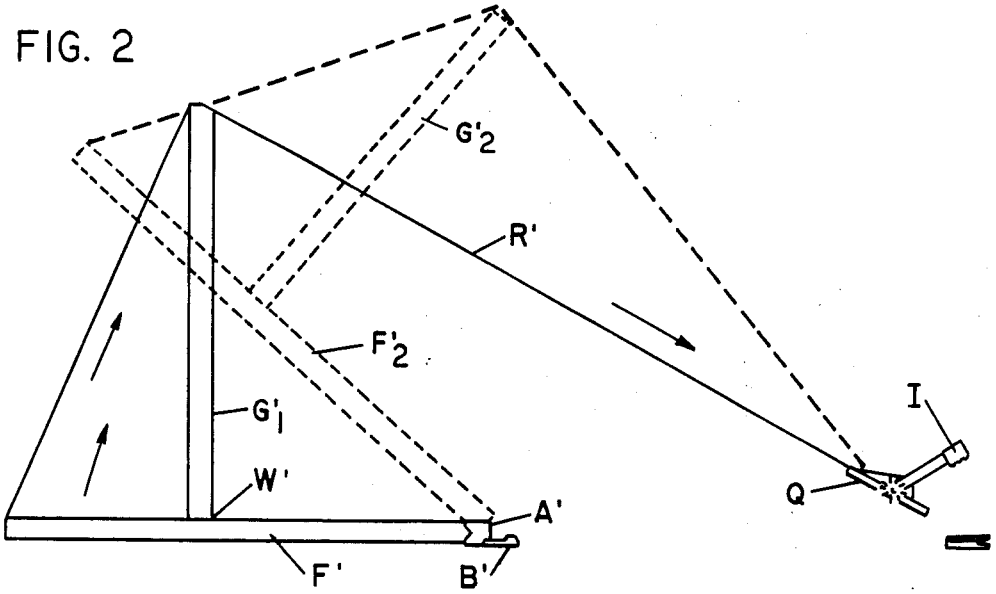
FIG. 2 is a view of a different embodiment of the method of erecting buildings.
Figure 3:
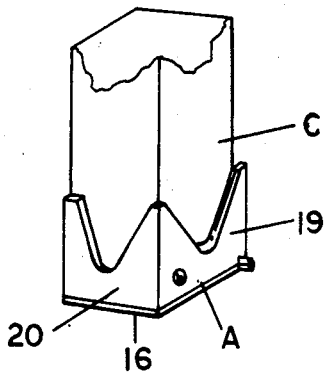
FIG. 3 is an enlarged partial view of the lower end of a column supported on a socket according to the invention.
Figure 4:
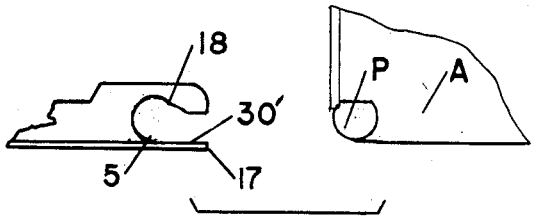
FIG. 4 is an enlarged exploded partial view of a part of the socket and the shoe used in the hinge connection for connecting the column to a footing.
Figure 5:
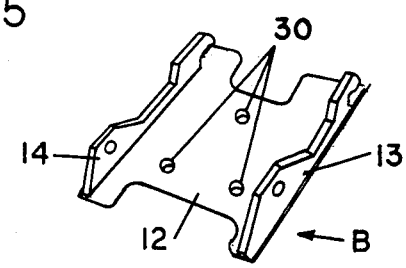
FIG. 5 is an isometric view of the shoe member.
Figure 6:
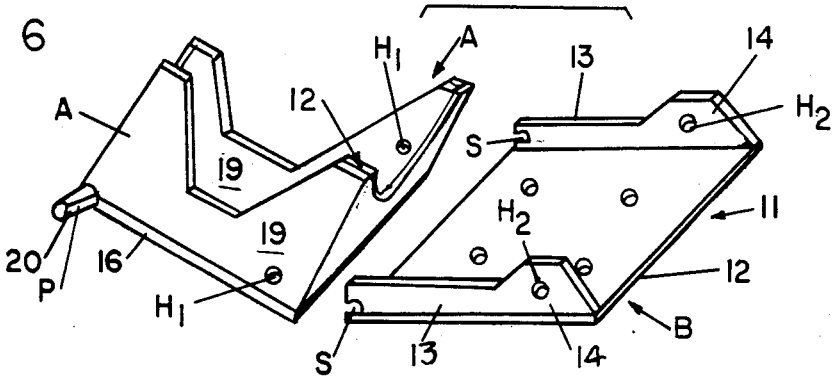
FIG. 6 is an exploded view showing a socket member and a shoe member according to the invention.
Figure 7:
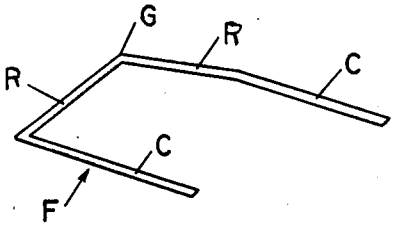
FIG. 7 is an isometric view of a building frame member.
Figure 8:
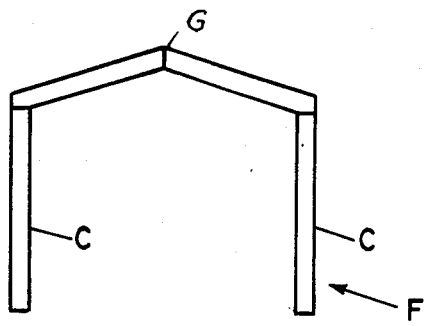
FIG. 8 is a front view of a building frame member.
Figure 9:
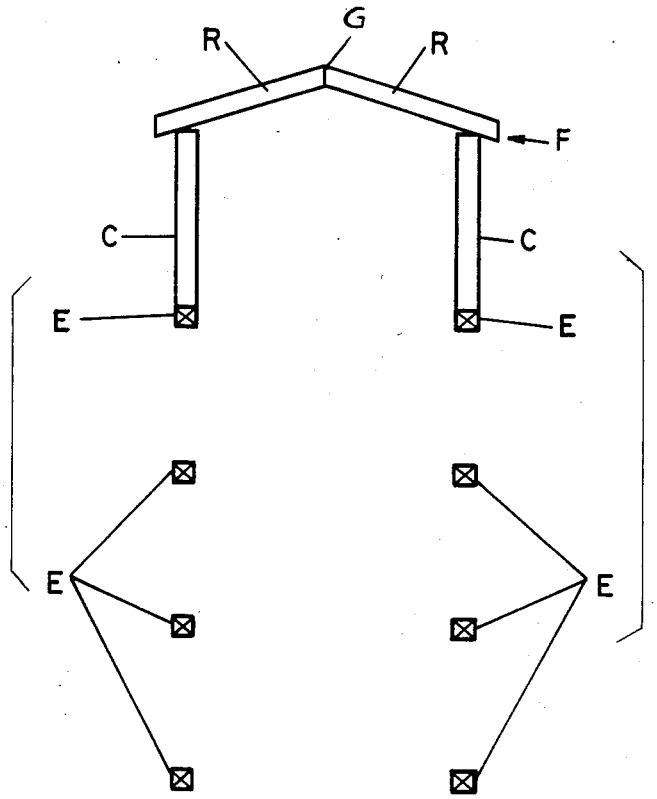
FIG. 9 shows a frame member similar to FIG. 8 supported adjacent a plurality of footings for providing a building arrangement.

In the embodiment of the invention shown in FIG. 2, a spacer G'1 is fixed to the frame F' at W'. The tensil member R' is passed from the upper end of the frame F' around the top of the spacer G'1 and then to the tensioning member Q which may be a cable tightener of a type familiar to those skilled in the art or the like having a handle I. As the tensil member R' is tightened, the cable will pull the frame up to the position F'2 and the spacer G'1 will be pulled to the position G'2 and from thence the cable will pull the frame to erect position. The hinge members A' and B' are shown supporting the lower end of the frame.

Holes 30 are formed in the bottom 12 of the shoe B for attaching the shoe to a footing E or the like. Holes H2 in each of the flanges of the shoe will align with holes H1 in the sides of the socket member A. Thus, when the column C is in erect position, the holes H1 will align with the holes H2 and a pin can be extended through the holes H1 and the holes H2 to hold the column in erect position.

The foregoing specification sets forth the invention in its preferred, practical forms but the structure shown is capable of modification within a range of equivalents without departing from the invention which is to be understood is broadly novel as is commensurate with the appended claims.

The embodiments of the invention in which an exclusive property or privilege is claimed are defined as follows:

1. A method of erecting a building having at least two columns comprising:

providing said columns, a tensil member, a tensioning member, at least two shoe members and two socket members for supporting said columns, each said column having a first end and a second end, said shoe members each comprising a plate-like bottom member, a first flange and a second flange, said bottom member having a first side, a second side, a first end and a second end, said first flanges and said second flanges each being fixed to said bottom at said first side and said second side and extending upwardly therefrom and defining a space therebetween, said first flange and said second flange each having a first side and a second side, said first side and said second side of each said flanges having a notch adjacent said bottom and adjacent said first ends, said socket members each comprising a flat plate-like bottom member and two spaced upwardly extending sides, said bottoms of said socket members each having a first side, a second side, a first end and a second end, said sockets each having a first pintel and a second pintel fixed to its said upwardly extending sides adjacent said bottom and adjacent said first end, said sockets each being adapted to receive a first end of a said column therein between said sides and means to attach said columns to said bottom of said socket, means on said bottom of said shoes to attach said shoes to foundation means, said shoes being adapted to receive a said socket with said bottom plate-like member of said socket disposed on said plate-like bottom member of said shoe in generally parallel relation thereto, said socket member having a flat plate-like bottom adapted to receive the first end of said column and means on said socket member to attach it to said column, said method comprising:

resting said columns on the ground, placing one said end of each said columns in each of said sockets, placing each of said sockets in a said shoe with said sides of said sockets received between said sides of said shoes and said pintels received in said notches whereby said columns can be swung from a horizontal position to a vertical position, and applying a tensil force to said tensil member whereby said columns are swung to a vertical position.

2. A method of erecting a building having at least two columns, structural members connecting the two columns comprising:

providing two columns each having a first end and a second end, providing two hinges disposed in spaced lateral position relative to one another having a first part and a second part pivoted to said first part, a post, two footings, a tension member, a tensioning member and said post having a first end and a second end, connecting said first end of said columns to said first part of said hinges and connecting said second part of said hinges to said footings, resting said columns on the ground in a horizontal position and providing a recess in the ground between said columns between said first end and said second end of said columns, supporting said first end of said post in said recess in the ground in a generally vertical position, connecting said tension member to said second end of said columns and supporting said tension member on said second end of said post, applying a tension to said tension member whereby said post holds said tensil member so that said tensil member applies a vertical component of force to said column and said tensil member lifts said second end of said column into vertical position, and locking said first part of said hinges to said second part of said hinges holding said second part of said hinges to said first part in said vertical position.

3. A method of erecting a column comprising:

providing a column having a first end and a second end, a post having a first end and a second end, a hinge, a foundation member, a tension member, and a prime mover, resting said column on the ground in a horizontal position and providing a recess in the ground adjacent said column between said first end and said second end of said columns connecting said column to said hinge and resting said tension member on said first end of said post with said column in a horizontal position, connecting said tension member to said second end of said column and supporting said post, in a generally vertical position, in said recess in the ground and passing said tension member over said first end of said post and applying a tension to said tension member whereby said column is lifted to vertical position.

* * * * *